US005622300A

United States Patent [19]

Robinson

[11] Patent Number: 5,622,300

[45] Date of Patent: Apr. 22, 1997

[54] ROLL PACK

[76] Inventor: Lawrence L. Robinson, 3512 133rd St. SW., Lynnwood, Wash. 98037

[21] Appl. No.: 563,523

[22] Filed: Nov. 28, 1995

Related U.S. Application Data

[63] Continuation-in-part of Ser. No. 345,138, Nov. 28, 1994, abandoned.

[51] Int. Cl.[6] ..... A47C 17/64

[52] U.S. Cl. ..... 224/575; 224/156; 224/586; 383/4; 190/2

[58] Field of Search ..... 224/575, 576, 224/577, 156, 578, 579, 580, 586, 932; 383/4; 190/2; 5/417, 419; D6/608

[56] References Cited

U.S. PATENT DOCUMENTS

| | | | |
|---|---|---|---|
| 33,385 | 10/1861 | Frodsham . | |
| 730,877 | 6/1903 | Clapham . | |
| 1,992,772 | 2/1935 | Ross . | |
| 2,626,648 | 1/1953 | Anderson | 383/4 |
| 4,068,786 | 1/1978 | Taniguchi . | |
| 4,101,994 | 7/1978 | Hoyt . | |
| 4,154,323 | 5/1979 | Sneider . | |
| 4,195,378 | 4/1980 | Parker | 190/2 |
| 4,197,891 | 4/1980 | Comollo . | |
| 4,375,111 | 3/1983 | Hall . | |
| 4,587,682 | 5/1986 | Schultz . | |
| 4,671,393 | 6/1987 | Rainey . | |
| 4,778,090 | 10/1988 | Facchina . | |
| 5,110,219 | 5/1992 | Lopes . | |
| 5,240,330 | 8/1993 | Thompson . | |
| 5,287,571 | 2/1994 | Rademacher | 383/4 |
| 5,346,308 | 9/1994 | Buhot et al. . | |
| 5,425,449 | 6/1995 | Boorady | 383/4 |

FOREIGN PATENT DOCUMENTS

| | | |
|---|---|---|
| 2577406 | 2/1985 | France . |
| 2687554 | 2/1992 | France . |

*Primary Examiner*—Henry J. Recla
*Assistant Examiner*—Charles R. Eloshway
*Attorney, Agent, or Firm*—Townsend and Townsend and Crew LLP

[57] ABSTRACT

A roll pack (10) is formed from a sheet of material having first and second edges. A first storage pocket (12) is positioned along the first edge of the sheet of material. An enclosure (20) is positioned along a second edge of the sheet. A strap (26) is attached to the second edge of the sheet near the enclosure (20). The strap (26) may be confined by the enclosure (20). When extended the strap (26) is used to secure the sheet of material when rolled up.

16 Claims, 4 Drawing Sheets

FIG. 3
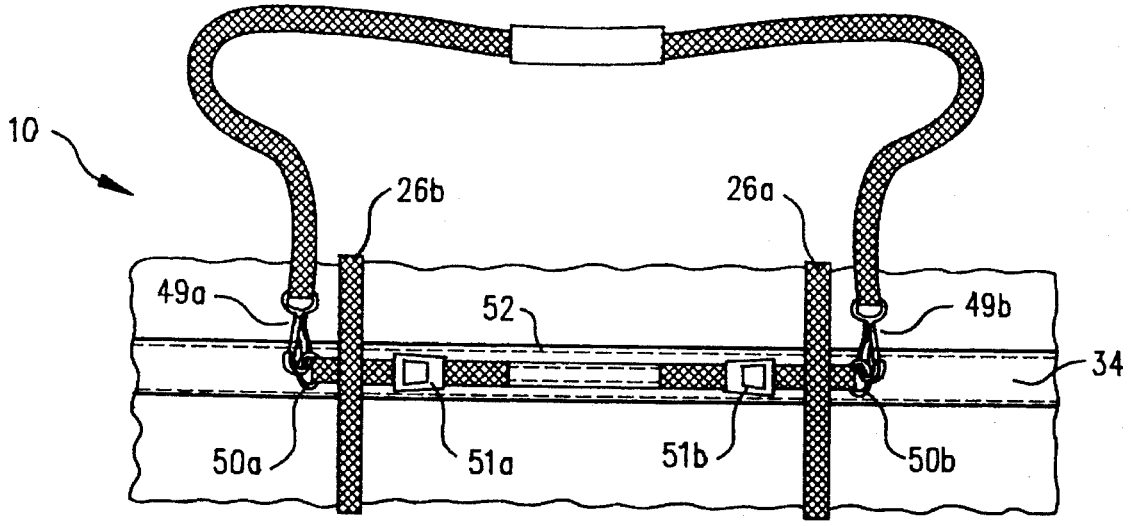
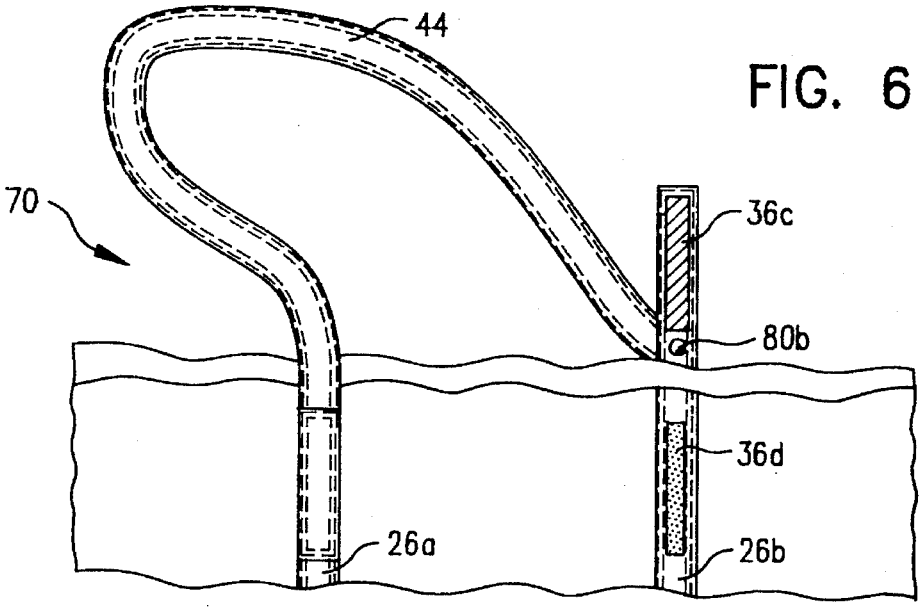
FIG. 6

ROLL PACK

RELATED APPLICATIONS

The present invention is a continuation-in-part of application Ser. No. 08/345,138, filed Nov. 28, 1994, now abandoned which is incorporated in its entirety herein by reference for all purposes.

BACKGROUND OF THE INVENTION

The present invention generally relates to devices employed to carry objects. More particularly, the present invention relates to a pack which may also be used as, e.g., a towel or blanket.

People frequently engage in activities which require that a towel or picnic blanket be carried in addition to various accessory items. For example, people commonly tote a towel along with books, suntan lotion, car keys, and other items to, e.g., a beach to sunbathe or swim. In the past, these individuals had to lug a knapsack or bag to carry the accessory items. The towel or blanket had to be carried separately or stuffed into the bag. In a similar situation, people living in barracks or dormitories frequently cart a towel, shaving kit, and shampoo to their community shower area. Carrying these items can become awkward and unwieldy. It is desireable, for the sake of convenience, efficiency, and simplicity, to provide a towel or blanket capable of carrying these accessory items.

Mats and pads have been designed in a manner which permit them to be easily carried. For example, U.S. Pat. Nos. 4,375,111 issued Mar. 1, 1983 to Hall, and 4,671,393 issued Jun. 9, 1987 to Rainey, each describe semirigid mats which can be folded to facilitate carrying using either integral handles or by inserting the mat into a bag. However, no provision is made to carry a towel and other accessory items. The Rainey and Hall references increase, rather than reduce, the number of items to be carried, e.g., to a beach, shower, or picnic site.

Others have provided bags which include portions that unroll into a mat providing a dry and clean place to sit. U.S. Pat. Nos. 4,068,786 issued Jan. 17, 1978 to Taniguchi, 4,154,323 issued May 15, 1979 to Sneider, and French Patent No. 2,687,554 published Aug. 27, 1993 to Juttet, each describe some form of tote bag which includes a folding mat portion. Again, however, a towel must still be carried by a user in addition to the tote bag. Further, the tote bags of Sneider and Juttet do not provide a full and comfortable surface upon which to recline. Sunbathers, for example, generally prefer to recline in a supine position. Any portion of the mat or tote which adds bulk can make the sunbather uncomfortable. Tote straps and handles get in the way, present dangers of entanglement, and can make a user uncomfortable. It is desirable to provide a device which eliminates or reduces the discomfort for a user while continuing to provide storage and carrying capabilities.

Sleeping bags and pads allow a user to fully recline. Some have also been designed with storage pockets. For example, U.S. Pat. Nos. 730,877 issued Jun. 16, 1903 to Clapham and 4,587,682 issued May 13, 1986 to Schultz each describe a sleeping bag arrangement which includes some storage for, e.g., clothing. Each of these designs, however, suffer in that a number of straps and buckles are required and because storage for bulky items are not provided. If, e.g., a book were stored in either the Schultz or Clapham designs, a user would not be able to comfortably recline on the bag. Further, these sleeping bags can not be used as towels. Not only is it desireable to provide a device which is comfortable and which has storage for bulky items, it is also desireable to permit the user to be able to dry off with, and wash the device as a normal towel.

Other designs have also been described. For example, U.S. Pat. Nos. 4,101,994 issued Jul. 25, 1981 to Hoyt, 4,197,891 issued Apr. 15, 1980 to Comollo, and U.S. Pat. Nos. 5,110,219 issued May 5, 1992 to Lopes, each describe folding beach mats and tote bags. None satisfy the need to provide a device which can function as a towel and as a tote. None permit a user to recline on the mat without discomfort from, e.g., stored items or handles. And further, none provide a simple approach to converting the mat into a carrying configuration.

Several designs have incorporated towels into a bag configuration. For example, U.S. Pat. No. 5,346,308 issued Sep. 13, 1994 to Buhot et al. details a beach towel which may be folded into a rucksack configuration. However, the design suffers in that complex folding and manipulation is required to perform the conversion. Further, a user of the Buhot device will suffer from discomfort from having to recline on the storage bag portion of the towel. If items are stored in the towel, a user is forced to lay on top of the items. In addition, once the towel becomes wet, any items carried in the rucksack will also become wet. French Patent No. 2577-406-A published Aug. 22, 1986 suffers from similar deficiencies in that the towel must be folded in a number of directions to place the towel in the bag portion. Items cannot be stored in the towel when the towel is in use.

A number of the above-noted references also suffer in that they use hardware and carrying straps which may clog or fail when used, e.g., on a beach. Sand can clog or damage unprotected hardware or straps. Further, sand tends to infiltrate pockets and other storage locations, making them unsuitable for the storage of items, such as eye glasses or food items, which could be harmed by the abrasive and intrusive effects of sand.

It is, therefore, desirable to provide a device which functions as a towel, which is readily converted to a carrying configuration, and which provides weather and sand-proof storage for items typically carried, e.g., to the beach. The device should also provide a place on which to sit or lie free from uncomfortable and annoying straps, pockets or other obstructions.

SUMMARY OF THE INVENTION

Accordingly, a roll pack is provided which is formed from a sheet of material having first and second edges. In one specific embodiment, a first storage pocket is positioned along the first edge of the sheet of material. A strap pocket is positioned along a second edge of the sheet. A strap is attached to the second edge of the sheet near the strap pocket. The strap may be stored in the strap pocket. When extended, the strap is used to secure the sheet of material when rolled up.

The roll pack may include several pockets along the first edge, each of which may have waterproof lining and may be sealed using, e.g., hook-and-loop fasteners. A second roll strap may also be provided to secure the roll. The second roll strap may also be stored in a strap pocket. This serves to both protect the roll straps and to ensure that a user of the roll pack is not disturbed or annoyed by the roll straps. One of the pockets along the first edge may be formed to store a pillow. The other pockets may store items to be carried using the roll pack. A user may comfortably lie on top of the sheet while items are stored in the pockets.

In one embodiment, the sheet of material is a towel, and the entire roll pack may be used as a towel. In another embodiment, the sheet of material is a blanket.

Carrying hardware may also be provided to facilitate carrying of the roll pack once in a rolled configuration. A removable shoulder strap and carrying handle may be provided.

For a fuller understanding of the nature and advantages of the invention, reference should be made to the ensuing description taken in conjunction with the accompanying drawings.

BRIEF DESCRIPTION OF THE DRAWINGS

FIG. 3 is a perspective view of the roll pack of FIGS. 1–2 in a carrying configuration;

FIG. 6 is a perspective view of the roll pack of FIGS. 4–5 in a carrying configuration.

DESCRIPTION OF SPECIFIC EMBODIMENTS

Figure 1:
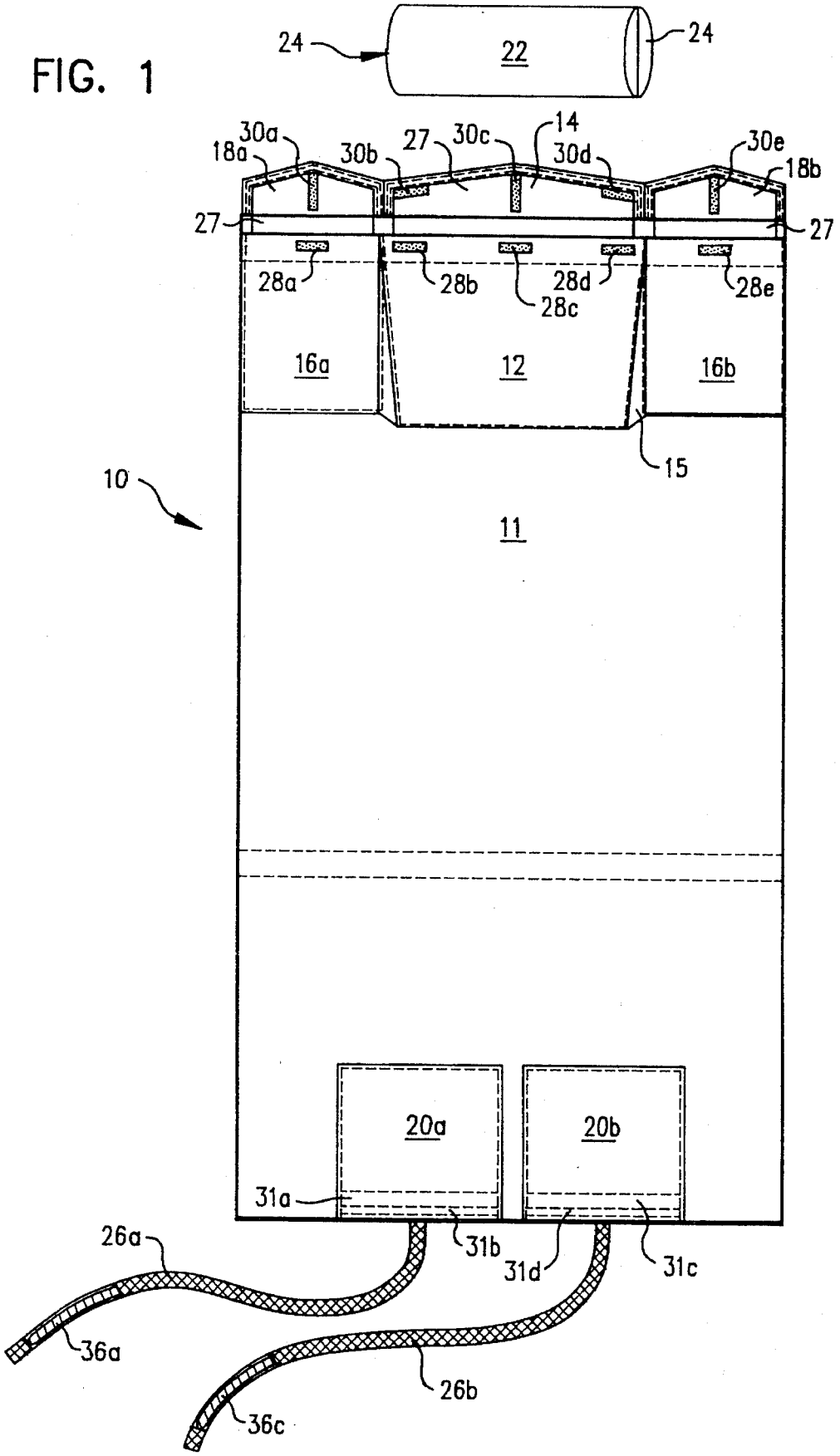
FIG. 1 is a top view of one embodiment of a roll pack according to the present invention.

Embodiments of the present invention will now be described by first referring to FIG. 1, where a top view of a roll pack 10 is shown. Roll pack 10, in one specific embodiment, may include a top surface 11 having a length and a width. Several pockets are formed on the roll pack 10. Side pockets 16*a,b* and center pocket 12 are positioned along one end of the roll pack while roll strap pockets 20*a,b* are positioned along a second end of the roll pack 10. Roll straps 26*a,b* are coupled to the second end of the roll pack. These straps may be stored within roll strap pockets 20*a,b*. Each pocket, including side pockets 16*a,b*, center pocket 12, and roll strap pockets 20*a,b*, may be closed to protect items stored therein. In the embodiment depicted in FIG. 1, roll strap pockets 20*a,b* are formed on the top surface of the roll pack 10. This permits easy access to the roll straps when the roll pack is spread out on the ground. However, the roll strap pockets 20*a,b* may also be formed on the bottom surface of the pack or split among both surfaces.

In one specific embodiment designed for use as a beach towel, roll pack 10 may be formed from terry cloth or other suitably absorbant material. Each of the pockets may be formed from similar material to permit the entire roll pack 10 to be used as a towel. The pockets may be sealed to protect and secure items contained therein. In one embodiment, side pockets 16*a,b* and center pocket 12 are sealed using side pocket flaps 18*a,b* and a center pocket flap 14. Each of these flaps may be provided with pocket closures 30*a–e*. These pocket closures 30*a–e* mate with pocket fasteners 28*a–e* provided on a surface of the side pockets 16*a,b* and the center pocket 12. In one specific embodiment, pocket closures 30*a–e* and pocket fasteners 28*a–e* may be formed using matching strips of hook-and-loop fasteners. Pocket closures 30*a–e* and pocket fasteners 28*a–e* may be secured to the flaps 14, 18*a,b* and pockets 12, 16*a,b* respectively, by stitches, glue, or the like.

Any or all of the pockets 12, 16*a,b* may be formed to have a depth. For example, in the embodiment depicted in FIG. 1, center pocket 12 has a depth 15 to accommodate larger items. For example, a pillow 22 may be inserted into pocket 12. Pillow 22 may be constructed from foam and provided with an exterior cover which contains, e.g., pillow pockets 24 positioned at one or both ends of the pillow 22. These pillow pockets 24 may be concealed, and may be used to store valuable items which require an extra measure of security such as car keys or money. Pillow 22 and center pocket 12 are preferably positioned in the center of one end of the roll pack 10 to permit, e.g., a sunbather to comfortably lie on the roll pack 10 without discomfort. Side pockets 16*a,b* are sized to permit the storage of relatively large items, such as a book, suntan lotion, or the like. These pockets are preferably positioned on each side of the center pocket 12. The result is a roll pack which can store items in side pockets 16*a,b* while permitting a user to comfortably lie on top of the towel. In a preferred embodiment, pockets 12 and 16*a,b* are separated from each other by stitching between the pockets. Alternatively, a single large pocket may be formed with hook-and-loop fasteners placed to separate portions into a center pocket portion and side pocket portions. In another embodiment of the present invention, pillow 22 is formed of closed cell foam designed to provide flotation. In this manner, a roll pack 10 may be used as an emergency flotation aid.

Roll strap pockets 20*a,b* may also be sealed from the environment. In one specific embodiment, the roll strap pockets are not provided with flaps. Instead, connector strips 31*a–d* may be provided to securely close roll strap pockets 20*a,b*. These connector strips 31*a–d* may also be formed from, e.g., matching hook-and-loop fastener strips. Connector strips 31*a–d* may be secured to the roll strap pockets 20*a,b* using stiches, glue, or other methods known in the art. Roll strap pockets 20*a,b* are used to hold and protect roll straps 26*a,b*. Roll straps 26*a,b* may be placed inside roll strap pockets 20*a,b* and secured by coupling connectors 31*a–d*. Each of the pockets 12, 16, and 20 may include an inner waterproof lining 27. The under portion of flaps 14, 18 may also include a waterproof lining 27. This waterproof lining serves to protect items stored within pockets 12, 16 and 20.

The use of the closures and fasteners in conjunction with the lined pockets enables a user to seal the pockets from the environment, effectively protecting the contents of the pockets from water, sand, dirt, sun, or other potentially damaging matter. Further, the flaps and fasteners ensure that items stored in the pockets do not fall out when the roll pack 10 is carried by a user or when the pack is used as a towel to dry a user off.

Roll straps 26*a,b* are coupled to a second end of the roll pack 10. These straps are secured to the roll pack 10, e.g., using stitches, glue or the like, and are used to secure roll pack 10 when assembled into a carrying configuration as described below. In one embodiment, the straps may be formed from, e.g., nylon webbing or other sturdy material. Roll straps 26*a,b* are provided with mating roll strap connector strips 36*a–d* attached to the straps. These connector strips may be formed from matching hook-and-loop fastener strips sewn, glued, or otherwise attached to the roll straps. Roll strap pockets 20*a,b* are positioned to receive the roll straps 26*a,b* when the straps are folded or otherwise placed inside pockets 20*a,b*. The pockets, which may be sealed from the environment as described above, allow the roll straps 26*a,b* to be stored neatly and out of the way so that, e.g., a sunbather does not become entangled in or bothered by the straps. Protection from the environment ensures the roll strap connector strips 36*a–d* are preserved. If, for example, hook-and-loop fasteners are used, the pockets will permit storage and protection of these fasteners, ensuring they are not clogged with, e.g., sand or dirt. The performance of hook-and-loop fasteners can be degraded or impaired when such materials foul the hooks and/or loops. Thus, the useful life of the roll pack 10 may be extended by providing pockets for the roll straps 26*a,b*.

Figure 2:
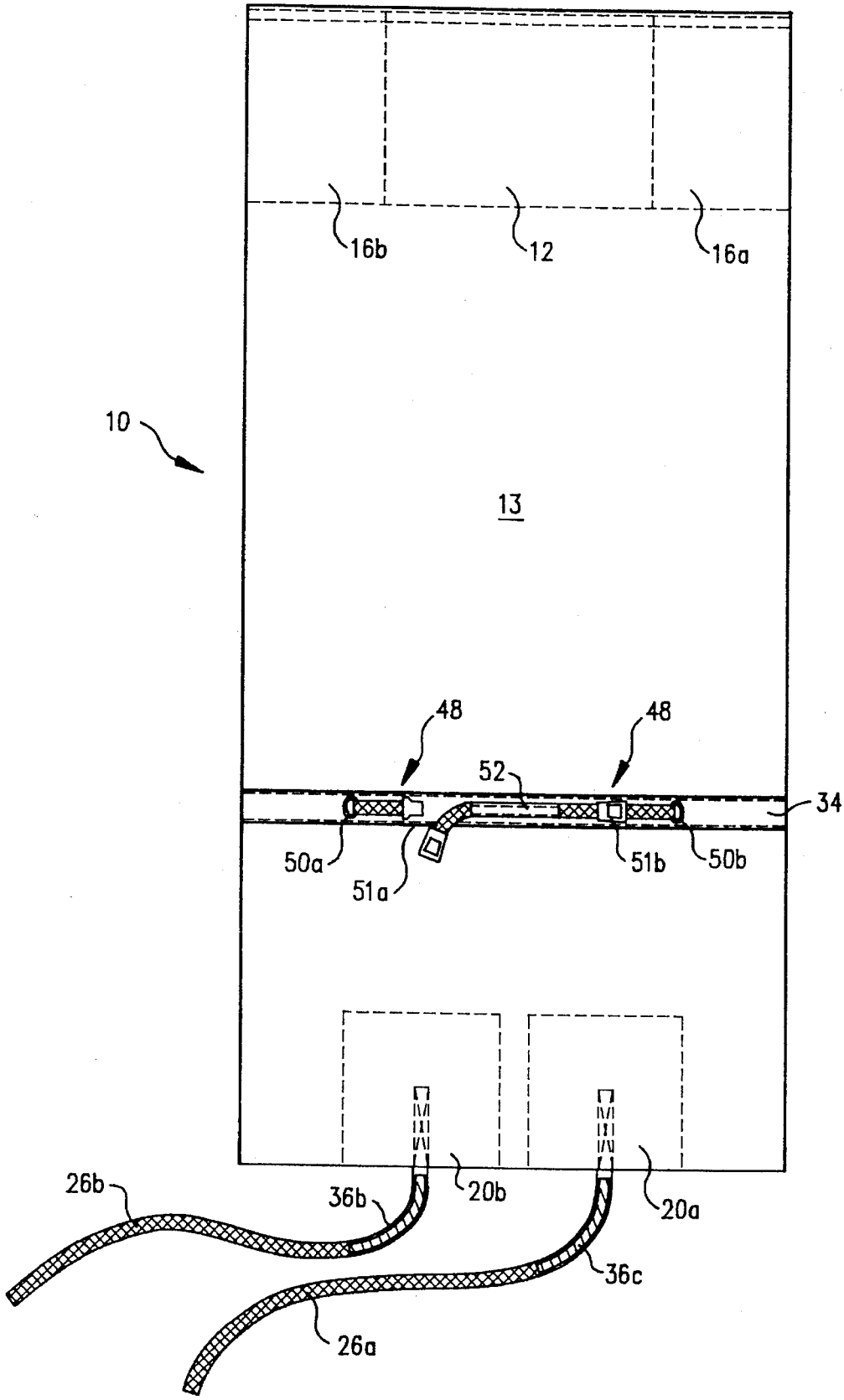
FIG. 2 is a bottom view of the roll pack of FIG. 1.

Referring now to FIG. 2, the bottom portion of a specific embodiment of the roll pack 10 is shown. The roll pack 10 includes a bottom surface 13, a support strip 34, carrying hardware 48, and a carrying handle 52. Support strip 34 may be formed from a thin strip of material to provide lateral support to the roll pack 10 when carried while permitting use of the roll pack as a flexible, absorbant towel. This support strip 34 may be sewn, glued or otherwise attached to the bottom surface 13 of the roll pack 10. Carrying hardware 48 and carrying handle 52 may be attached to roll pack 10 and to the support strip 34. Carrying hardware 48 may include a pair of D-rings 50*a,b* coupled to a shoulder strap 44 and to the carrying handle 52 via detachable clips 51*a,b*. The carrying handle 52 may be formed from a thin strip of nylon webbing which may be reinforced with, e.g., a leather carrying strap. In one embodiment, the carrying handle 52 is removably coupled to the pair of D-rings using detachable clips 51*a,b*.

The carrying hardware 48 is placed on the bottom portion 13 of the roll pack 10 to ensure that a user, such as a sunbather, may lie in a prone position on the top surface of the roll pack without experiencing discomfort from the carrying hardware. Typically, a user will lie in a position such that her head rests on pillow 22 positioned within center pocket 12. In this fashion, carrying hardware 48 is located at or near the users knees. User comfort may be further enhanced by forming support strip 34 from a length of terry cloth material or the like. This shelters a user from the carrying hardware while providing some support to the roll pack 10 when carried. A user will typically remove the carrying handle 52 and shoulder strap 44 to further maximize comfort while lying or sitting on the roll pack 10. The handle and strap may be stored in one of the pockets 12, 16*a,b* of the roll pack 10. Other types of carrying hardware 48 may also be used to facilitate carrying of the pack and to improve user comfort.

Roll pack 10 may be formed into a pack to permit easy carrying of both the roll pack as well as the items stored within pockets of the pack. The roll pack 10 is rolled from the end having center pocket 12 toward the end having roll strap pockets 20*a,b*. Roll straps 26*a,b* are then wrapped around the exterior of the rolled pack to secure the towel in the rolled configuration. Roll straps 26*a,b* are secured by mating roll strap connector strips 36*a*/36*b* and 36*c*/36*d* to one another. A roll pack 10 in pack form is shown in FIG. 3. This configuration ensures that items stored within the center or side pockets are very secure during transport, protected by both securing the flaps and by rolling the pockets within the pack. Stored items will be securely contained within the pack during a long walk even if a user forgets to close a flap. The roll pack 10 may be quickly assembled into pack form. No complex folding is required. Further, the capacity of the pack may be expanded if a larger item is carried within one of the pockets—to accommodate a larger item, roll straps 26*a,b* are simply expanded accordingly.

A shoulder strap 44 may be coupled to carrying hardware 48 to permit easy carrying of the roll pack. Shoulder strap 44 may include a shoulder patch 45 to provide further carrying comfort. In one embodiment, the strap is formed from a strip of nylon webbing, although any durable material may be used. A strip of terry cloth material may also be used, for example. A pair of clips 49*a,b* may be used to secure the shoulder strap to the carrying hardware 48 via D-rings 50*a,b*, although other attachment mechanisms may be used, including, as examples, buttons, snaps, hook-and-loop fasteners, and the like. Preferably, any attachment mechanism used will permit ready removal of the shoulder strap 44 to ensure user comfort when the roll pack 10 is laid out for use or when the roll pack is used as a towel.

The result is a device which easily converts from, e.g., a towel to a pack. The device is comfortable to lie on, as it does not have any obstructions or bulky portions. Protective pockets are provided which permit dry and sand free storage of items typically carried, e.g., to the beach. The device, thus, functions as a towel, as a pack, and as a comfortable place on which to sit or lie.

Figure 4:
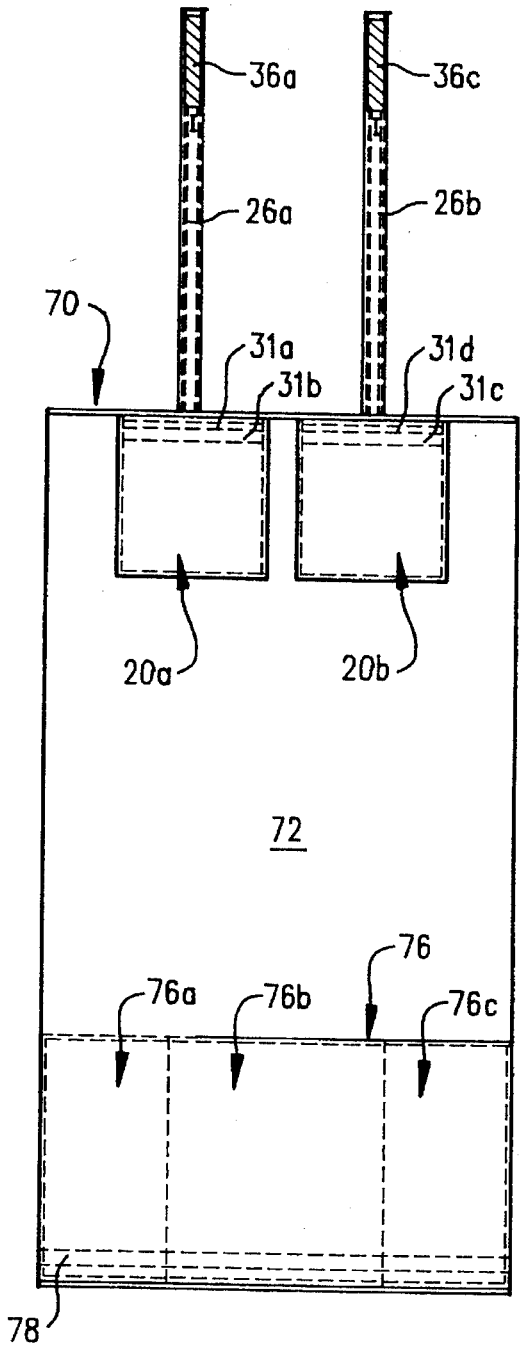
FIG. 4 is a top view of a second embodiment of a roll pack according to the present invention.

A second specific embodiment of a roll pack 70 according to the present invention will now be described by first referring to FIG. 4. In this specific embodiment, roll pack 70 may be used as, e.g., a bath towel. Roll pack 70 has a top surface 72, two roll strap pockets 20*a,b* and a pair of roll straps 26*a,b* on one end of the roll pack 70. A large segmented pocket 76 is placed on the other end. Large segmented pocket 76 may be divided into a number of smaller pockets 76*a–c*. This division may be permanently made, by stitching, gluing or otherwise dividing pockets 76*a–c*. Alternatively, the division may be nonpermanent. For example, pockets 76*a* and 76*b* may be separated using buttons or hook-and-loop construction. Such a division would permit expansion or contraction of the pockets as needed, e.g., from a single large pocket to three smaller pockets to one large pocket and one small pocket.

Each pocket, including roll strap pockets 20*a,b* and pockets 76*a–c*, may be closed using pocket closures 31*a–d* and 77, 78. These pocket closures may be formed from strips of matching hook-and-loop fasteners. Each of the pockets may also be provided with waterproof lining to protect items stored therein.

Figure 5:
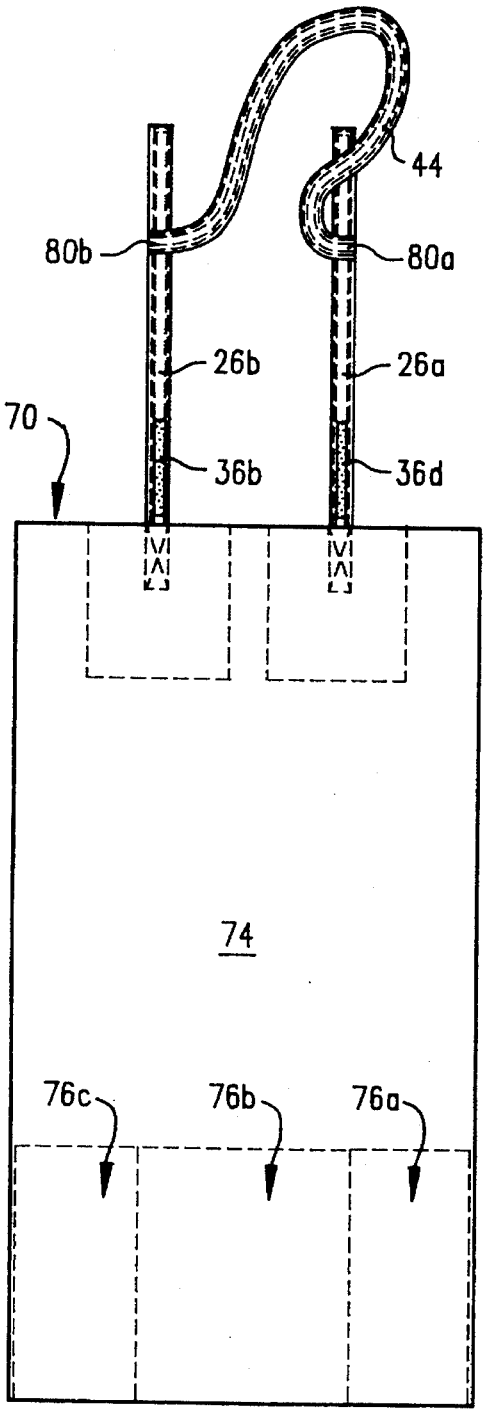
FIG. 5 is a bottom view of the roll pack of FIG. 4.

Referring to FIG. 5, the bottom surface 74 of roll pack 70 is shown. In this particular embodiment, no devices or attachments are exposed on the bottom surface, freeing the entire surface for use, e.g., as a bath towel. Shoulder strap 44 is shown-attached to roll straps 26*a,b*. Shoulder strap is removably coupled to the roll straps at attachment points 80*a,b*. In one embodiment, shoulder strap 44 may be attached using buttons, one positioned at point 80*a*, and one at point 80*b*. In another embodiment, the shoulder strap 44 may be attached using hook-and-loop fasteners or snaps. Other fasteners may also be employed. Every component, including the pockets, the roll straps, and the shoulder strap of roll pack 70 may be formed from terry cloth or other suitably absorbant material. This facilitates use of the entire device as a bath towel. A typical user of roll pack 70 is a dormitory resident. The resident's shaving kit may be placed in waterproof pocket 76*b*, while a change of underwear or other items may be placed in pockets 76*a* or 76*c*. These items will be protected by the waterproof lining of the pockets. The roll pack 70 may then be rolled into a carrying configuration as shown in FIG. 6. Items stored in the pockets 76*a–c* will be securely stowed within the roll pack 70. The dormitory resident may then easily carry the entire pack, e.g, slung over her shoulder, to the dormitory showering facility. Once there, the pack may be unrolled and the roll straps, carrying handle, and shoulder strap stored within the pockets of the roll pack. The pack may then function as a bath towel.

The result is a pack which functions both as a carrying device as well as a towel. The roll pack 70 is easily assembled into a carrying configuration, and securely stores items to be carried. Items stored within the roll pack 70 are protected by a waterproof lining. Further, the entire configuration may be washed as a normal towel.

As will be appreciated by those familiar with the art, the present invention may be embodied in other specific forms without departing from the spirit or essential characteristics thereof. For example, a shoulder strap and roll straps may be incorporated into a single element by using a shoulder strap with two loops large enough to receive a roll pack in a rolled configuration. The shoulder strap and loops may be formed from a length of nylon webbing. In this embodiment, roll straps and roll strap pockets do not need to be provided on the roll pack, thereby minimizing cost and construction time.

Roll packs according to the present invention may also be used to carry larger quantities of accessory items. For example, a picnic blanket may be provided with pockets and roll straps as detailed above. Additional pockets may also be provided along the spare edges of the picnic blanket to store further items. Further still, and caps may be provided to secure items stored within the blanket. These end caps may be circular in shape and may be positioned in the open ends of the rolled blanket. The end caps may be secured using, e.g., draw strings. These end caps may serve double duty by also being used as plates for a picnic.

Other variations and embodiments are also possible. For example, while hook-and-loop fasteners have been described, other fasteners known in the art may also be used. In addition, while roll strap pockets have been described, other enclosures for the straps may be provided. Roll straps have been described to secure the roll pack. However, any of a number of attachment methods Nay be used to secure the pack, including buttons, straps, hook-and-loop fasteners, snaps, and the like.

Accordingly, the disclosure of the invention is intended to be illustrative, but not limiting, of the scope of the invention which is set forth in the following claims.

What is claimed is:

1. A roll pack, comprising:

a sheet of material, said material having a first edge and a second edge positioned apart from said first edge;

at least a first storage pocket, positioned proximate said first edge;

at least a first enclosure, positioned proximate said second edge and having an access opening facing said second edge;

at least a first strap, having a first end attached to said sheet within said at least first enclosure and an opposite free end;

wherein said at least first enclosure is used to enclose said at least first strap when said at least first strap is in a non-use position; and wherein said at least first strap is secured around said sheet of material when said sheet is rolled up.

2. The roll pack of claim 1 further comprising at least a second and a third storage pocket positioned adjacent said at least first storage pocket.

3. The roll pack of claim 2 wherein each of said storage pockets have a waterproof lining.

4. The roll pack of claim 2 wherein each of said storage pockets are sealable.

5. The roll pack of claim 2, further comprising:

a shoulder strap, removably coupled between said first and second straps.

6. The roll pack of claim 1 further comprising:

a second strap, positioned along said second edge proximate a second enclosure and confined by said second enclosure.

7. The roll pack of claim 1 further comprising a pillow, formed to fit within said at least first storage pocket.

8. The roll pack of claim 1, further comprising:

a support strip, positioned between said first and second edges, for providing lateral support to said roll pack;

strap hardware, coupled to said support strip; and a shoulder strap, removably coupled to said strap hardware.

9. The roll pack of claim 8, further comprising:

a carrying handle, removably coupled to said strap hardware.

10. The roll pack of claim 1 wherein said sheet of material is a sheet of absorbant cloth and said roll pack is used as a towel.

11. The roll pack of claim 1 wherein said sheet of material is a blanket.

12. A towel pack, comprising:

a towel;

at least a first pocket, positioned proximate one end of said towel, said first pocket having a closing device for closing said at least first pocket;

attachment means for securing said towel in a rolled configuration, said attachment means including a first and a second roll strap, attached proximate a second end of said towel, at least a first attachment point on each of said first and second roll straps, for securing said first and second roll straps around said towel; and first and second roll strap pockets, positioned on said towel proximate said first and second roll straps, said first and second roll straps each having an end which is mounted in a respective one of said first and second roll strap pockets;

wherein said first and second roll strap pockets are adapted to enclose said first and second roll straps when said first and second roll straps are in a non-use position.

13. The towel pack of claim 12 further comprising:

a support strip, positioned between said first and second ends of said towel;

strap ties, attached to said support strip, for removably coupling a shoulder strap to said towel pack.

14. The towel pack of claim 12 further comprising second and third pockets, positioned proximate said first edge of said towel, said second and third pockets each having a closing device for closing said second and third pockets.

15. The towel pack of claim 12 wherein said attachment means comprises:

a removable carrying strap having a first loop and a second loop, said first and second loops adapted to receive said towel when said towel is rolled up.

16. The towel pack of claim 12 wherein one of said first, second and third pockets is adapted to receive a pillow.

* * * * *